United States Patent [19]

Sorensen

[11] 4,430,130

[45] Feb. 7, 1984

[54] BASKETBALL GOAL

[76] Inventor: Roald H. Sorensen, 3224 Marie Dr., Raleigh, N.C. 27604

[21] Appl. No.: 299,808

[22] Filed: Sep. 8, 1981

[51] Int. Cl.[3] ..... C21D 9/00; A63B 63/08

[52] U.S. Cl. ..... 148/12 B; 148/12.4; 273/1.5 R

[58] Field of Search ..... 273/1.5 R, 1.5 A; 148/12 B, 12 F, 12 R, 131, 14, 134, 144, 12.4

[56] References Cited

U.S. PATENT DOCUMENTS

| | | | |
|---|---|---|---|
| 2,053,635 | 9/1936 | Sandeberg | 273/1.5 R |
| 4,040,872 | 8/1977 | Mudiare | 148/12 B |
| 4,285,518 | 8/1981 | Pearo | 273/1.5 R |

*Primary Examiner*—Paul E. Shapiro

*Attorney, Agent, or Firm*—Mills & Coats

[57] ABSTRACT

This invention is a method of producing an improved basketball goal rim including forming a rim from standard sized diameter steel, heat treating the rim to stress relief, harden and temper the same, and allowing said rim to cool. The rim is constructed from hot rolled annealed round rod of high carbon steel in the Class of 4140 containing approximately 0.41 percent carbon, 0.97 percent magnesium, 0.012 percent phosphorous, and 0.022 percent sulphur by volume. The rim is heated to between 1100 and 1350 degrees Fahrenheit for a period of 45 to 75 minutes. The temperature is then increased to between 1400 and 1700 degrees Fahrenheit and maintained at such temperature for 30 to 60 minutes, and then is oil quenched to a temperature between 150 and 175 degrees Fahrenheit for a period of 15 to 25 minutes. Finally the rim is tempered at between 750 and 775 degrees Fahrenheit for a period of 90 to 150 minutes.

11 Claims, 2 Drawing Figures

BASKETBALL GOAL

FIELD OF INVENTION

This invention relates to athletics and more particularly to the game of basketball and the equipment used in the playing thereof.

BACKGROUND OF INVENTION

Since the game of basketball was first developed the structural integrity of both the rim and the backboard has been a problem. As the average player has become taller and bigger over the years, the problem of bent rims and damaged backboards due to slam-dunks and player impact has substantially increased.

The above problems in fact became so severe that in 1967 the National Collegiate Athletic Association passed a "no-dunk" rule. Some ten years later in 1977, however, the "pro-dunk" rule was voted back in as a crowd pleasing gesture and to add new excitement to the game.

Tempered glass backboards have come into wide spread use because of their stiffness which allows a ball to remain alive when contacting the playing surface. This, however, compounds the problem in that blitz plays by over zealous players not only can bend rims but they also shatter backboards with some regularity. To replace a rim or backboard is not only expensive in and of itself but during televised ball games the delay time in making repairs becomes extremely costly.

Spring loaded rims and break away devices have been developed in an effort to overcome the above mentioned problems. First, the players immediately know that they are playing on a "funny rim" and not a standard rim thus immediately psyching the players which invariably affects their game performance. Also the stiffness and thus rebound characteristics of the rim is not the same as the standard rim and therefore adds even further to the degradation of the players performance.

BRIEF DESCRIPTION OF INVENTION

After much research and study into the above mentioned problems, the present invention has been developed to provide a basketball rim which retains the same physical appearance as the present standard or regular rim and yet will sustain two to three times the load and absorb at least four times the energy than the best standard rim presently available. This is accomplished by constructing the rim from a special type of steel which is specially treated so that it can withstand greatly increased loads and deflections without permanent bending. This is accomplished without any significant change in material stiffness, the only physical change being a slight diameter increase in the rim supports. Thus by greatly reducing the bent rim problem as well as substantially reducing the number of damaged and destroyed backboards, the rim of the present invention is relatively inexpensive to the users thereof.

The above is accomplished by forming the rim from a specially selected hot rolled, high carbon annealed round rod, relieving the stress within the material created during the forming of the rim, heat treating the stress relieved rim to give it flexibility rather than brittleness and finally tempering the rim before welding the board mounting plate and V-bar supports thereto.

In view of the above it is an object of the present invention to provide a basketball goal including a rim which will support over twice the load pounds as a conventional rim without incurring a permanent bend.

Another object of the present invention is to provide a basketball goal rim which will deflect up to 2 inches during heavy load conditions and yet will return to its original position without permanent bend.

Another object of the present invention is to provide a basketball goal which can withstand the pressures of abuse from heavy slam-dunk activities from large overly enthusiastic players without becoming bent or destroying the backboard.

Another object of the present invention is to provide a process for producing an improved basketball rim including pre-stress relieving the rim by mechanical means, and stress relieving the same through heat treat means.

Another object of the present invention is to provide a basketball goal which is relatively immune to rim bending and backboard destruction and yet for all practical purposes is identical to standard basketball goals in configuration.

Other objects and advantages of the present invention will become apparent and obvious from a study of the following description and the accompanying drawings which are merely illustrative of such invention.

DETAILED DESCRIPTION OF INVENTION

Figure 1:
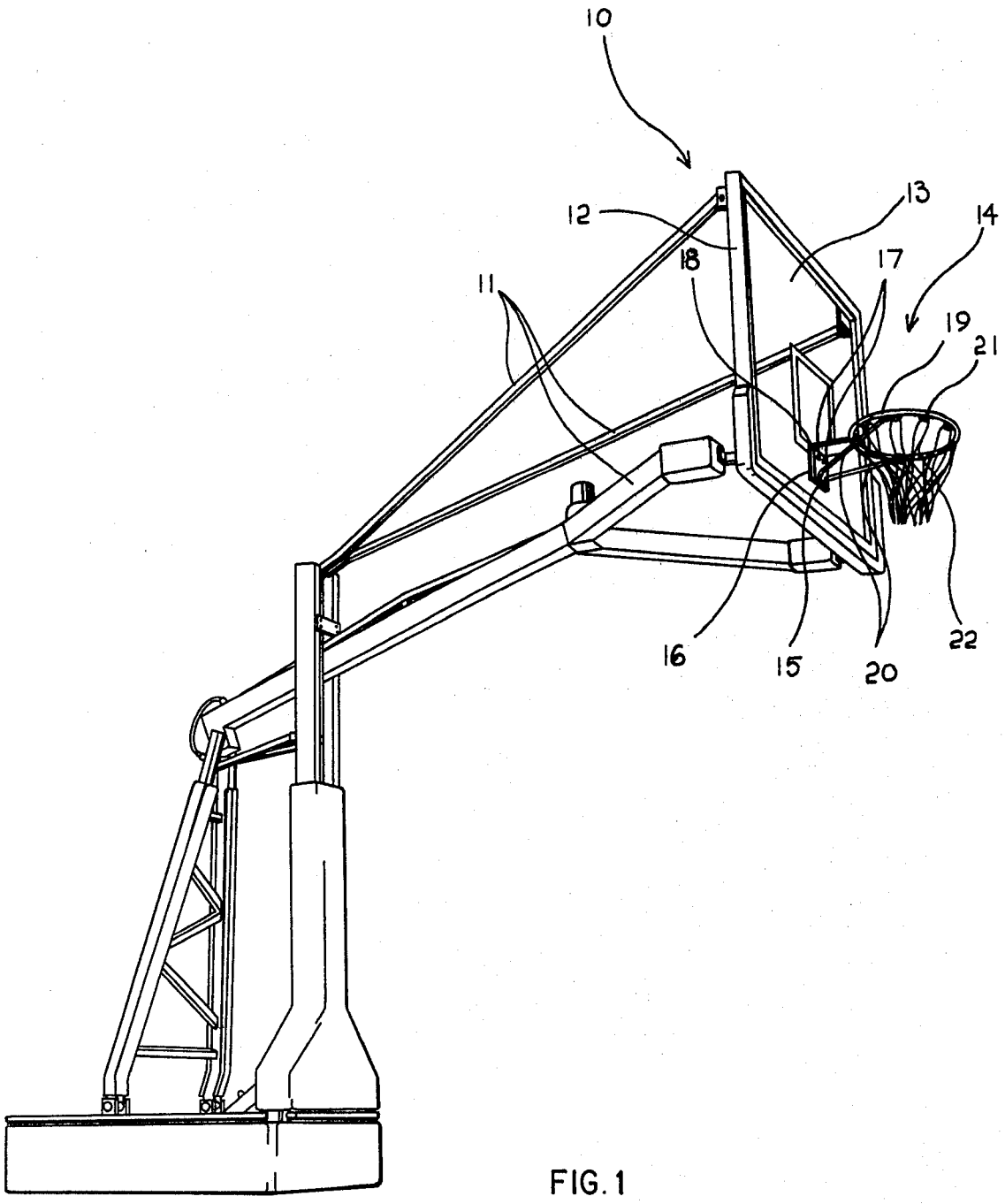
FIG. 1 is a perspective view of a typical basketball goal incorporating the improvements of the present invention.
Figure 2:
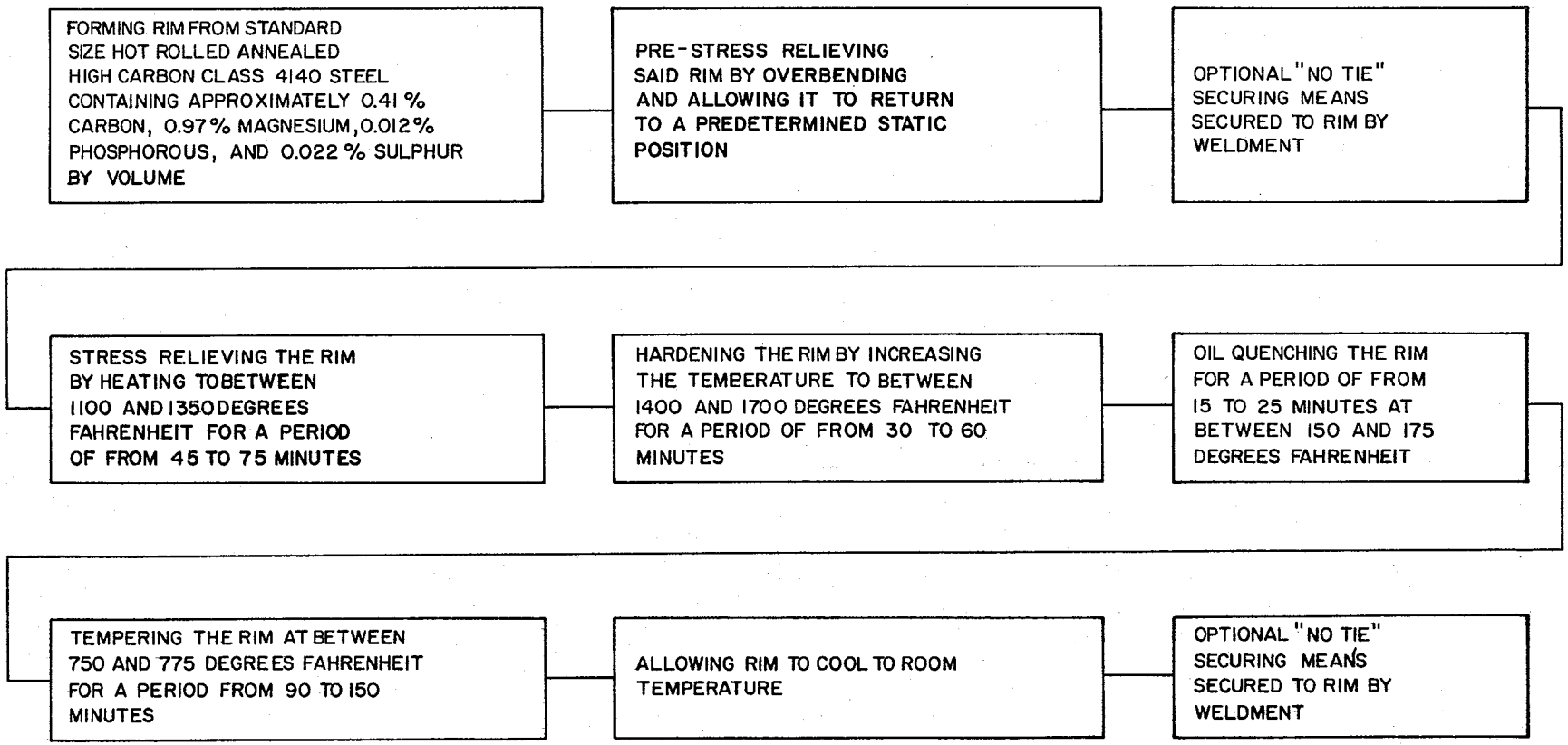
FIG. 2 is a block diagram showing the steps of the process of the present invention.

With further reference to the drawings, a typical basketball goal unit is indicated generally at 10 and includes support arms 11 secured to a backboard mounting frame 12. This backboard mounting frame has a backboard 13 mounted thereon which is preferably constructed from tempered glass although wood and other materials have obviously been used for the same purpose.

The basketball goal itself, indicated generally at 14, includes a board mounting plate 15 which is bolted through the backboard 13 to backing plate 16 by mounting bolts 17.

The upper portion of the board mounting plate 15 is connected to the rim mounting plate 18 which in turn is weldingly secured to rim 19.

V-bar supports 20 extend from either side of rim 19 to the lower portion of board mounting plate 15 as can clearly be seen in the drawing. Finally, steel wire "no-tie" net securing means 20 are provided in spaced relation about the lower portion of rim 19. The "no-tie" securing means are adapted to engage the upper portion of net 21 in the normal manner.

In-depth analyzation of destroyed backboards that have occurred since the "pro-dunk" rule change in 1977 led to the discovery that in almost all cases a permanently bent rim accompanied backboard failure. Taking this into consideration, the idea of breakaway or spring loaded rims was considered but generally been discarded as impractical because of the different bounce or rebound characteristics of such rims which would inherently affect the playing of the game of basketball.

In looking for an alternate solution to the problem, extensive experimentation has been conducted with standard rims to determine both their vibration resonant characteristics as well as their flex characteristics in inch-pound loading prior to failure. As a result of these experimentations it was determined that the best standard regulation basketball rims will withstand up to approximately 250 pounds of load which will cause a deflection of approximately 0.8 of an inch. Any loading above 250 pounds will cause permanent deflection or bending of the rim to the point that it will not return to its original position.

By beefing up the V-bar supports from standard ½ inch rod stock to ⅝ inch rod stock (which is the same size rod material that standard rims are formed from) the rims can withstand a loading of approximately 400 pounds and flexing of slightly over 1 inch before permanent bending occurs. Although this is somewhat better than the present standard rims, this slight increase of approximately 150 pounds of load before failure was not deemed acceptable in overcoming the bent rim and destroyed backboard problem.

Through further extensive experimentation and testing it was discovered that by using the same high carbon spring steel used in the experiments reaching 400 pound loading and by stress relieving the same, then heat treating it, quenching it, and tempering it, loads in excess of 800 pounds with a deflection of over 2 inches could be achieved without board damage or permanent rim bending.

To accomplish the above unusual results, standard size ⅝ inch diameter hot rolled annealed round rod of a blend of high carbon spring steel is formed into a standard 18 inch interior diameter circle. To pre-stress relieve the rim during forming, it is over bent to an exact point and then allowed to return to a static position forming the desired 18 inch diameter circle.

The rod stock forming the rim of the present invention is preferably formed from class 4140 steel which is made for heat treat process and stressed to flex rather than break in a brittle state. The 4140 steel is a hot rolled, annealed material containing 0.41 percent carbon by volume, 0.97 percent magnesium, 0.012 percent phosphorous, and 0.022 percent sulphur. The Jominy Range is from 56 at 1 to 35 at 32 with a Rockwell of Once the rim has been formed and pre-stress relieved as hereinabove described, it is stress relieved by placing it in an oven at between 1100° F. and 1350° F. for a period of 45 to 75 minutes and allowing heat to build therein. Next the temperature is increased to between 1400° F. and 1700° F. and the already hot rim is allowed to remain at such temperatures for a period of 30 to 60 minutes. The rim is then oil quenched for a period of 15 to 25 minutes at 150° F. to 175° F. and then tempered at 750° F. to 775° F. for a period of 90 to 150 minutes. Each of the rims are then allowed to cool to room temperature where they can be sand blasted clean and welded into the final basketball goal assembly.

As a specific example of the treatment sequence, each rim is stree relieved by 1250° F. for 60 minutes, is then heat treated at 1550° F. for 45 minutes within the same oven. Each of the rims is then oil quenched at 150° F. for 15 minutes and then tempered at 750° F. for 120 minutes. The rims are then removed, allowed to cool at room temperature and are sand blasted to clean the scale therefrom and are ready for the final welding and painting process.

It should be noted that the rim itself is the only part of the basketball goal assembly to be subjected to the heat treat process. Once the harding process has been completed then the necessary additional fabrication can be performed.

Standard shaped steel wire "no-ties" net securing means 21 can be fixed to the bottom side of each of the rims either before or after the heat treat at the fabricators preference. In either case they are spot welded in place. It should be noted that care must be taken not to exert excessive pressure on the rim during the spot welding so as to cause dimpling which would weaken the rim itself.

The mounting plate 18 as well as the ⅝ inch diameter V-bar supports 20 are secured to the rim by normal V and fillet welding procedures.

The basket assembly is then painted with a powder-bake process for long-lasting attractiveness and metal protection.

Basketball goals made by the above-indicated process provide a stronger, more forgiving, flexible, basketball goal than has heretofore been known. Under maximum player induced loads this rim will flex 2.3 times further than normally expected from today's best rims used in competitive play at the most advanced collegiate and professional levels. It should be noted that the flex is not experienced until forces have far exceeded those that now permanently bend rims and destroy glass backboards.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. The method of producing an improved basketball goal rim comprising: forming the rim from standard sized diameter steel; heating said rim to stress relief the same; increasing the temperature to heat treat and harden the rim; cooling said rim to maintain hardness; and reheating said rim to temper the same and give it spring whereby an improved basketball rim is provided which can withstand heavy static loads and large deflections without permanent yield.

2. The method of claim 1 wherein said rim is constructed from hot rolled annealed round rod of high carbon steel.

3. The method of claim 2 wherein said rim is constructed from Class 4140 Steel.

4. The method of claim 3 wherein said Class 4140 Steel contains approximately 0.41 percent carbon, 0.97 percent magnesium, 0.012 percent phosphorous and 0.022 percent sulphur by volume.

5. The method of producing an improved basketball goal rim comprising: forming the rim from standard sized diameter hot rolled annealed high carbon spring steel rod; stress relieving the formed rim by heating it to between 1100 and 1350 degrees Fahrenheit for a period of from 45 to 75 minutes; increasing the temperature to between 1400 and 1700 degrees Fahrenheit and maintaining such temperature for a period of from 30 to 60 minutes; oil quenching the rim at 150 to 175 degrees Fahrenheit for a period of 15 to 25 minutes; tempering said rim at 750 to 775 degrees Fahrenheit for a period of 90 to 150 minutes; and allowing said rim to cool to room temperature whereby an improved basketball rim is provided which can withstand at least 800 pounds of static load and deflect at least two inches without permanent yield.

6. The method of claim 5 including prestress relieving of said rim by overbending the same to a predetermined point and allowing it to return to a predetermined static formed position.

7. The method of claim 5 wherein "no tie" net securing means are weldingly secured to said rim prior to the treated process.

8. The method of claim 5 wherein "no tie" net securing means are weldingly secured to said rim subsequent to the heat treated process.

9. The method of claim 5 wherein said rim is constructed from Class 4140 Steel.

10. The method of claim 9 wherein said Class 4140 Steel contains approximately 0.41 percent carbon, 0.97 percent magnesium, 0.012 percent phosphorous and 0.022 percent suphur by volume.

11. The method of producing an improved basketball goal rim comprising: forming a rim from standard sized diameter steel; heat treating said rim to stress relief, harden, and temper the same; and allowing said rim to cool whereby an improved basketball rim is provided which can withstand heavy static loads and large deflections without permanent yield.

* * * * *